United States Patent [19]

Kawai et al.

[11] Patent Number: 4,946,400

[45] Date of Patent: Aug. 7, 1990

[54] SURFACE MOUNTED ELECTRICAL CONNECTOR

[75] Inventors: Mitsuru Kawai; Masaru Yoshida; Yoshihiro Sasaki, all of Tokyo, Japan

[73] Assignee: Hirose Electric Co., Ltd., Tokyo, Japan

[21] Appl. No.: 407,627

[22] Filed: Sep. 15, 1989

[30] Foreign Application Priority Data

Oct. 4, 1988 [JP] Japan ..... 63-129623[U]

[51] Int. Cl.[5] ..... H01R 9/09

[52] U.S. Cl. ..... 439/79; 439/95; 439/609; 439/903

[58] Field of Search ..... 439/76, 79–83, 439/95, 607, 609, 903

[56] References Cited

U.S. PATENT DOCUMENTS 4,842,554 6/1988 Cosmos et al. ..... 439/609

4,842,555 6/1988 Cosmos et al. ..... 439/609

FOREIGN PATENT DOCUMENTS 62-074770 5/1987 Japan .

*Primary Examiner*—Paula A. Bradley

*Attorney, Agent, or Firm*—Kanesaka & Takeuchi

[57] ABSTRACT

A mounting structure includes an insulating housing (10) having an annular recess (14) extending rearwardly from a front end thereof for receiving a shell member of a mating connector; a metal end face protection member (40) attached to the front end and having a circular opening (41) for receiving the shell member; a pair of attachment sections (43) extend rearwardly from opposite sides of the end face protection member; a pair of leg members (45) extending downwardly from lower edges of the attachment sections to be secured to a printed circuit board (50); and a latch device (13B) provided within the insulating housing for engagement with the attachment sections whereby the end face protection member is locked to the insulating housing.

8 Claims, 1 Drawing Sheet

SURFACE MOUNTED ELECTRICAL CONNECTOR

BACKGROUND OF THE INVENTION

The present invention relates generally to electrical connectors and, more particularly, to a mounting structure for mounting an electrical connector on a printed circuit board.

A mounting structure of this type is described in Japanese U.M. Pat. Application Kokai No. 62-74770. This electrical connector includes an insulating housing having a lateral recess extending forwardly from the rear end thereof and a vertical recess extending downwardly from the rear portion of the lateral recess, and an attachment member having a lateral section fitted into the lateral recess and a leg member which extends downwardly from the lateral section and fits in the vertical recess and into an aperture of a printed circuit board.

The lateral section of the attachment member extends almost up to the front end of the insulating housing into which a mating connector is plugged so that the plugging force is distributed to the lateral section.

The electrical connector, however, has the following disadvantages.

(1) The lateral section of the attachment member extends into the lateral recess so long that when a lateral force is applied to the insulating housing upon plugging, the lateral section is bent outwardly allowing too much play between the insulating housing and the attachment member. Consequently, a concentrated load is applied to the leg member upon plugging causing a crack in the solder joint between the leg member and the circuit board resulting in separation of the solder joint.

(2) The leg member also serves as contact so that it is necessary to make it from a thick metal sheet to give satisfactory spring property. This cause weak engagement between the lateral section and the lateral recess, resulting in premature loose engagement between them.

(3) The engagement between the lateral recess and the latch projection on the tip of the lateral section is not sufficient to withstand repeated plugging operations, resulting in too much play between the lateral recess and the lateral section.

SUMMARY OF THE INVENTION

Accordingly, it is an object of the invention to provide a mounting structure capable of firmly mounting a shielded electrical connector on a printed circuit board.

According to the invention the above object is accomplished by a mounting structure which includes an insulating housing having an annular recess extending rearwardly from a front end thereof for receiving a shell member of a mating connector; a metal end face protection member attached to the front end and having a circular opening for receiving the shell member; a pair of attachment sections extend rearwardly from opposite sides of the end face protection member; a pair of leg members extending downwardly from lower edges of the attachment sections to be secured to a printed circuit board; and a latch device provided within the insulating housing for engagement with the attachment sections whereby the end face protection member is locked to the insulating housing.

The end face protection member, which is made separately from the shield member made from a thin metal sheet for its complicated form, is made from a thick metal sheet so that the attachment section with the leg member is made strong.

Other objects, features, and advantages of the invention will be apparent from the following description when taken in conjunction with the accompanying drawings.

DESCRIPTION OF THE PREFERRED EMBODIMENT

Figure 1:
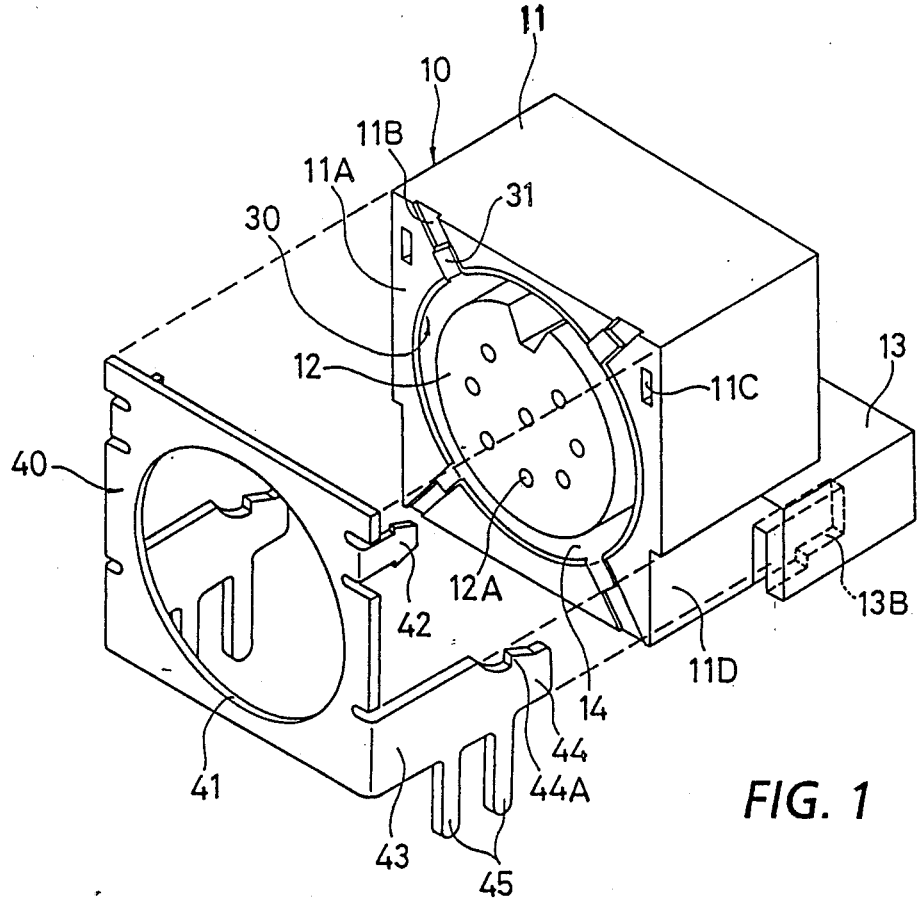
FIG.1 is an exploded perspective view of an electrical connector according to an embodiment of the invention.
Figure 2:
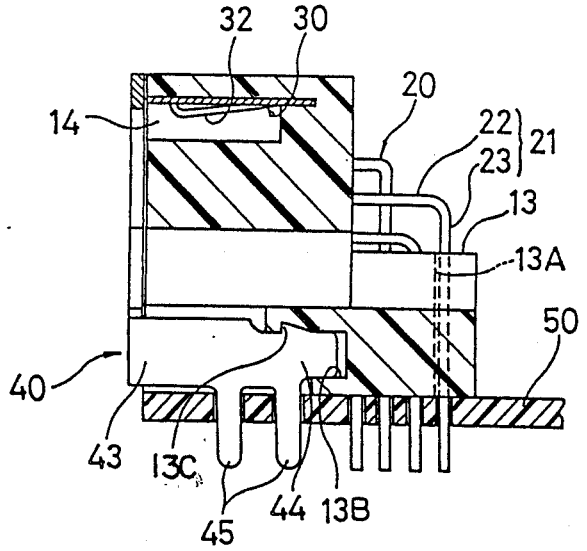
FIG. 2 is a sectional view of the electrical connector mounted on a printed circuit board.

An embodiment of the invention is described below with reference to the accompanying drawings, wherein the electrical connector includes an insulating housing 10, contact elements 20, a cylindrical shield member 30, and an end face protection member 40.

The insulating housing 10 is molded from a dielectric material, such as a plastic, so as to have a housing body 11, a cylindrical contact support 12, and a rear contact holder 13. An annular recess 14 is defined between the housing body 11 and the contact support 12. The substantially cubic housing body 11 has on the front surface 11A four cutout seats 11B on which contact lugs 31 of the shield member 30 rest. A pair of latch slots 11C are provided on the upper corners of the front surface 11A to receive latch lances 42 of the end face protection member 40. A pair of attachment recesses 11D extend rearwardly from the lower portion of the front surface 11A to receive attachment sections 43 of the end face protection member 40.

The contact support 12 has a pluality of contact apertures 12A into which the contact portions (not shown) of contact elements 20 are inserted. The contact holder 13 has a plurality of contact channels 13A for arranging the connection portions 21 of contact elements 20. A pair of retention slots 13B are provided on opposite sides of the contact holder 13 to receive and retain free ends 44 of the attachment sections 43. The annular recess 14 is made so as to receive the cylindrical shield member 30 and the shell member of a mating connector (not shown).

Each contact element 20 is made by stamping and forming a spring conductive metal sheet so as to have a contact portion (not shown) for contact with a contact element of a mating connector and a connection section 21 which consists of an intermediate portion 22 extending rearwardly from the contact portion, and a terminal portion 23 extending downwardly from the intermediate portion 22.

The cylindrical shield member 30 is made by stamping and forming a spring metal thin sheet so as to have four contact lugs 31 extending outwardly at substantially right angles to the longitudinal axis from the front edge thereof for engagement with the cutout seats 11B of the insulating housing 10. A plurality of cantilever contacts 32 extend forwardly and inwardly from the rear portion of the circumferential surface of the shield member 30.

The end face protection member 40 is made by stamping and forming a thick metal sheet so as to have a circular opening 41 at the center for receiving the shell member of a mating connector. It has a square shape which is substantially identical with the front surface 11A of the insulating housing 10. A pair of latch lances 42 extend rearwardly from the upper portion of the end face protection member 40. A pair of attachment sections 43 extend rearwardly from the lower portion of the end face protection member 40. Each attachment section 43 has a free end 44 to be inserted into the retention slot 13B of the contact holder 13. A leg member 45 extends downwardly from the middle portion of the attachment section 43. The free end 44 has an upward projection 44A for engagement with a shoulder 13C of the retention slot 13B.

The electrical connector is assembled as follows.

(1) The contact portions of L-shaped contact elements 20 are inserted into the contact apertures 12A from the back. Simultaneously, the cylindrical shield member 30 is inserted into the annular recess 14 from the front.

(2) The end face protection member 40 is attached to the front face 11A of the insulating housing 10 by pushing the latch lances 42 and the attachment sections 43 into the latch slots 11C and the attachment recess 11D.

(3) The thus assembled electrical connector is mounted on a printed circuit board 50, with the terminal portions 23 of contact elements 20 and the leg members 45 of the end face protection member 40 soldered to a signal circuit and a ground circuit of the printed circuit board 50, respectively.

According to the invention there are provided the following advantages.

Since the attachment sections are integrally made with the end face protection member from a thick metal sheet, their physical strength is sufficient to resist against the outward bending force exerted upon plugging operation little or, no concentrated load is applied to the leg members.

The diameter of the circular opening in the end face protection member is made substantially equal to the outside diameter of a mating shell so as to guide the mating connector. Thus, it is possible to reduce the plugging force and the load on the attachment sections, thus further avoiding outward bending of the attachment sections.

We claim:

1. A surface mounted electrical connector comprising:

an insulating housing having an annular recess extending rearwardly from a front end thereof for receiving a shell member of a mating connector;

a cylindrical shield member made from a thin metal sheet and fitted into said annular recess;

contact means provided on a front edge of said cylindrical shield member;

an end face protection member made from a metal sheet which is thicker than said thin metal sheet and attached to said front end so that it comes into contact with said contact means to provide electrical continuity;

a pair attachment sections extending rearwardly from opposite lower sides of said end face protection member;

a pair of leg members extending downwardly from lower edges of said attachment sections to be secured to a printed circuit board; and latch means provided on opposite sides of said insulating housing for engagement, in part, with said attachment sections, whereby said end face protection member is locked to said insulating housing.

2. The electrical connector of claim 1, wherein said front end protection member has a pair of latch lances extending rearwardly from opposite upper sides thereof for engagement with latch slots provided on said insulating housing, whereby said end face protection member is secured to said insulating housing.

3. The electrical connector of claim 1, wherein said cylindrical shield member has at least one cantilever contact extending forwardly and inwardly from a rear portion thereof.

4. The electrical connector of claim 1, wherein said end face protection member has a circular opening, the diameter of which is substantially equal to the outside diameter of a mating shell so that it serves as a guide for said mating connector.

5. The electrical connector of claim 1, wherein said insulating housing comprises a substantially cubic housing body having a pair of attachment recesses on opposite lower sides and a rear contact holder having a pair of retention slots opening into a front end thereof into which said attachment sections are pushed for latching said end face protection member to said insulating housing.

6. The electrical connector of claim 5, wherein said attachment sections have a projection which is provided on a top edge of said attachment section and engages a shoulder which is provided on a top surface of said retention slot, whereby said end face protection member is locked to said insulating housing.

7. The electrical connector of claim 1, wherein said contact means is a contact lug extending radially from a front edge of said cylindrical shield member.

8. The electrical connector of claim 7, wherein said insulating housing has a cutout seat such that said contact lug rests on said cutout seat when said cylindrical shield member is fitted into said annular recess.

* * * * *